US009803339B2

(12) United States Patent
Nanjo et al.

(10) Patent No.: US 9,803,339 B2
(45) Date of Patent: Oct. 31, 2017

(54) HYDRAULIC CONTROL DEVICE AND OPERATING MACHINE HAVING THE SAME

(71) Applicants: Kobe Steel, Ltd., Kobe-shi (JP); KOBELCO CONSTRUCTION MACHINERY CO., LTD., Hiroshima-shi (JP)

(72) Inventors: Takao Nanjo, Kobe (JP); Saburo Senoo, Hiroshima (JP); Naoki Goto, Hiroshima (JP)

(73) Assignees: Kobe Steel, Ltd., Kobe-shi (JP); KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 335 days.

(21) Appl. No.: 14/350,611

(22) PCT Filed: Oct. 15, 2012

(86) PCT No.: PCT/JP2012/006597
§ 371 (c)(1),
(2) Date: Apr. 9, 2014

(87) PCT Pub. No.: WO2013/057919
PCT Pub. Date: Apr. 25, 2013

(65) Prior Publication Data

US 2014/0245729 A1 Sep. 4, 2014

(30) Foreign Application Priority Data

Oct. 17, 2011 (JP) ..... 2011-227749

(51) Int. Cl.
*F15B 21/14* (2006.01)
*E02F 9/22* (2006.01)
(Continued)

(52) U.S. Cl.
CPC ..... *E02F 9/2217* (2013.01); *E02F 9/2091* (2013.01); *E02F 9/226* (2013.01);
(Continued)

(58) Field of Classification Search
CPC ..... F15B 21/14; F15B 2211/5157; F15B 2211/88
See application file for complete search history.

(56) References Cited

U.S. PATENT DOCUMENTS 4,611,528 A * 9/1986 Nanda ..... F15B 13/02 137/596.15
5,287,794 A * 2/1994 Andersson ..... F15B 11/003 91/436
(Continued)

FOREIGN PATENT DOCUMENTS

CN 1969129 A 5/2007
CN 1993524 A 7/2007
(Continued)

OTHER PUBLICATIONS

Extended European Search Report dated Jun. 3, 2015 in Patent Application No. 12842326.6.
(Continued)

*Primary Examiner* — F. Daniel Lopez
(74) *Attorney, Agent, or Firm* — Oblon, McClelland, Maier & Neustadt, L.L.P.

(57) ABSTRACT

A hydraulic control device includes: a recovery oil passage; a regenerative motor that rotates an output shaft of an engine in response to a supply of the hydraulic fluid and is driven to rotate by rotation of the output shaft of the engine; a regenerative oil passage for guiding return oil from a boom cylinder to the regenerative motor without passing the return oil through the recovery oil passage; a coupling oil passage that couples the recovery oil passage and the regenerative oil
(Continued)

passage to each other; and a regeneration-side check valve that is provided on the coupling oil passage, and allows the hydraulic fluid to flow from the recovery oil passage toward the regenerative motor, and moreover restricts the hydraulic fluid from flowing from the regenerative motor toward the recovery oil passage.

4 Claims, 4 Drawing Sheets

(51) Int. Cl.
*E02F 9/20* (2006.01)
*F15B 13/06* (2006.01)

(52) U.S. Cl.
CPC ..... *E02F 9/2285* (2013.01); *E02F 9/2289* (2013.01); *E02F 9/2292* (2013.01); *E02F 9/2296* (2013.01); *F15B 13/06* (2013.01); *F15B 21/14* (2013.01); *F15B 2211/20546* (2013.01); *F15B 2211/253* (2013.01); *F15B 2211/7053* (2013.01); *F15B 2211/7058* (2013.01); *F15B 2211/88* (2013.01)

(56) References Cited

U.S. PATENT DOCUMENTS

| | | | |
|---|---|---|---|
| 6,282,890 | B1 | 9/2001 | Takano |
| 6,460,332 | B1 | 10/2002 | Maruta et al. |
| 2007/0186548 | A1 | 8/2007 | Smith et al. |
| 2007/0204606 | A1 | 9/2007 | Imanishi et al. |
| 2008/0314038 | A1 | 12/2008 | Tozawa et al. |
| 2009/0077837 | A1 | 3/2009 | Tozawa et al. |

FOREIGN PATENT DOCUMENTS

| | | | |
|---|---|---|---|
| CN | 101029650 | A | 9/2007 |
| CN | 101403405 | A | 4/2009 |
| CN | 101408212 | A | 4/2009 |
| CN | 201865132 | U | 6/2011 |
| CN | 102182730 | A | 9/2011 |
| JP | 2000-136806 | | 5/2000 |
| JP | 2001-50202 | A | 2/2001 |
| JP | 2003-120616 | | 4/2003 |
| JP | 2006-64071 | | 3/2006 |
| JP | 2007-263160 | | 10/2007 |
| JP | 2009-138538 | | 6/2009 |

OTHER PUBLICATIONS

International Search Report dated Dec. 18, 2012, in PCT/JP2012/006597, filed Oct. 15, 2012.

Combined Office Action and Search Report dated Jun. 25, 2015 in Chinese Patent Application No. 201280050962.7 (with English Summary and English Translation of Category of Cited Documents).

* cited by examiner

HYDRAULIC CONTROL DEVICE AND OPERATING MACHINE HAVING THE SAME

TECHNICAL FIELD

The present invention relates to a hydraulic control device for controlling the supply and discharge of hydraulic fluid to and from a hydraulic actuator, and an operating machine having the hydraulic control device.

BACKGROUND ART

There has conventionally been known an operating machine that has a supporting body, a slewing body supported turnably on the supporting body, a boom attached so as to be raised and lowered with respect to the slewing body, a slewing motor for slewing the slewing body, a boom cylinder for raising and lowering the boom, a hydraulic pump for supplying hydraulic fluid to the slewing motor and boom cylinder, a flow rate control valve for controlling the supply and discharge of the hydraulic fluid to and from the slewing motor and the boom cylinder, and a throttling valve provided in a meter-out oil passage extending from the slewing motor and the boom cylinder.

This type of operating machine controls the actuation of the slewing motor and the boom cylinder by adjusting the flow rate of the hydraulic fluid that flows from the hydraulic pump and operating the flow rate control valve. When, for example, lowering the boom, the potential energy corresponding to the level of the boom before the lowering acts in a direction in which the boom is accelerated. This potential energy is discarded as thermal energy that is generated when the hydraulic fluid passes through the throttling valve. Similarly, when decelerating the slewing motion of the slewing body, inertial energy of the slewing body acts in a direction interfering with deceleration of the slewing body. This inertial energy, too, is discarded as thermal energy that is generated when the hydraulic fluid passes through the throttling valve.

A hydraulic control device disclosed in Patent Document 1, for example, is known as the technology for regenerating these energies. The hydraulic control device disclosed in Patent Document 1 has an engine, a hydraulic pump having a drive shaft coupled to a rotation axis of the engine, a variable capacity-type hydraulic motor having a drive shaft coupled to the drive shaft of the hydraulic pump, an actuator activated by the supply of hydraulic fluid from the hydraulic pump, a switching valve for controlling the supply and discharge of the hydraulic fluid to and from the actuator, a pilot pump that generates pilot pressure for operating the switching valve. The hydraulic control device disclosed in Patent Document 1 rotates the engine by supplying the hydraulic fluid, which returns from the actuator, to the variable capacity-type hydraulic motor. Thereby regeneration of hydraulic energy can be accomplished.

In the hydraulic control device disclosed in Patent Document 1, the variable capacity-type hydraulic motor is constantly rotated by the engine even when the hydraulic energy regeneration is not accomplished. In such a case, for the purpose of suppressing the occurrence of cavitation in the variable capacity-type hydraulic motor, the hydraulic fluid is fed from the pilot pump to the variable capacity-type hydraulic motor at all times.

In the hydraulic control device disclosed in Patent Document 1, the variable capacity-type hydraulic motor is rotated by using some of the hydraulic fluid supplied from the pilot pump to the switching valve, which, in other words, some of the power for operating the switching valve. This results in a loss of power of the pilot pump in an effort to prevent the occurrence of cavitation in the variable capacity-type hydraulic motor.

The hydraulic control device disclosed in Patent Document 1 also has a check valve for preventing the hydraulic fluid, which serves to the energy regeneration, from being introduced to a pilot circuit. Specifically, this check valve allows the hydraulic fluid to flow from the pilot pump to the variable capacity-type hydraulic motor, and at the same time restricts the hydraulic fluid from flowing from the variable capacity-type hydraulic motor to the pilot pump. The discharge pressure of the pilot pump is set high enough to operate the switching valve. Therefore, the cracking pressure for opening the check valve also needs to be set at a relatively high level. For this reason, in the hydraulic control device disclosed in Patent Document 1, a significant amount of power that is calculated by multiplying the cracking pressure by a supply flow rate of the hydraulic fluid supplied to the variable capacity-type motor is lost.

Patent Document 1: Japanese Unexamined Patent Publication No. 2003-120616

SUMMARY OF THE INVENTION

An object of the present invention is to provide a hydraulic control device and an operating machine having the same, the hydraulic control device being capable of suppressing the occurrence of cavitation in a regenerative motor that regenerates the energy of a hydraulic actuator, while reducing the loss of power.

In order to achieve this object, the present invention provides a hydraulic control device having: a hydraulic pump that is driven by rotation of an output shaft of an engine; at least one hydraulic actuator that is activated by a supply of hydraulic fluid from the hydraulic pump and includes a regenerative actuator, return oil to be derived from the regenerative actuator being used for regeneration; a recovery oil passage that recovers, into a tank, the hydraulic fluid derived from the at least one hydraulic actuator and the hydraulic pump; a regenerative motor that rotates the output shaft of the engine in response to the supply of the hydraulic fluid and is driven to rotate by rotation of the output shaft of the engine; a regenerative oil passage that guides the return oil from the regenerative actuator to the regenerative motor without passing the return oil through the recovery oil passage; a coupling oil passage that couples the recovery oil passage and the regenerative oil passage to each other; and a regeneration-side check valve that is provided on the coupling oil passage, allows the hydraulic fluid to flow from the recovery oil passage toward the regenerative motor, and restricts the hydraulic fluid from flowing from the regenerative motor toward the recovery oil passage.

The present invention is an operating machine having: a base machine; a boom attached to the base machine so as to be raised and lowered with respect to the base machine; a boom cylinder that raises and lowers the boom with respect to the base machine; and the hydraulic control device, wherein the hydraulic control device includes the boom cylinder as the regenerative actuator.

The present invention can suppress the occurrence of cavitation in the regenerative motor that regenerates the energy of the hydraulic actuator, while reducing the loss of power.

BEST MODE FOR CARRYING OUT THE INVENTION

Embodiments of the present invention are described hereinafter with reference to the accompanying drawings. The embodiments described below are merely illustrative in embodying the present invention and are not to be construed as limiting the technical scope of the present invention.

Figure 1:
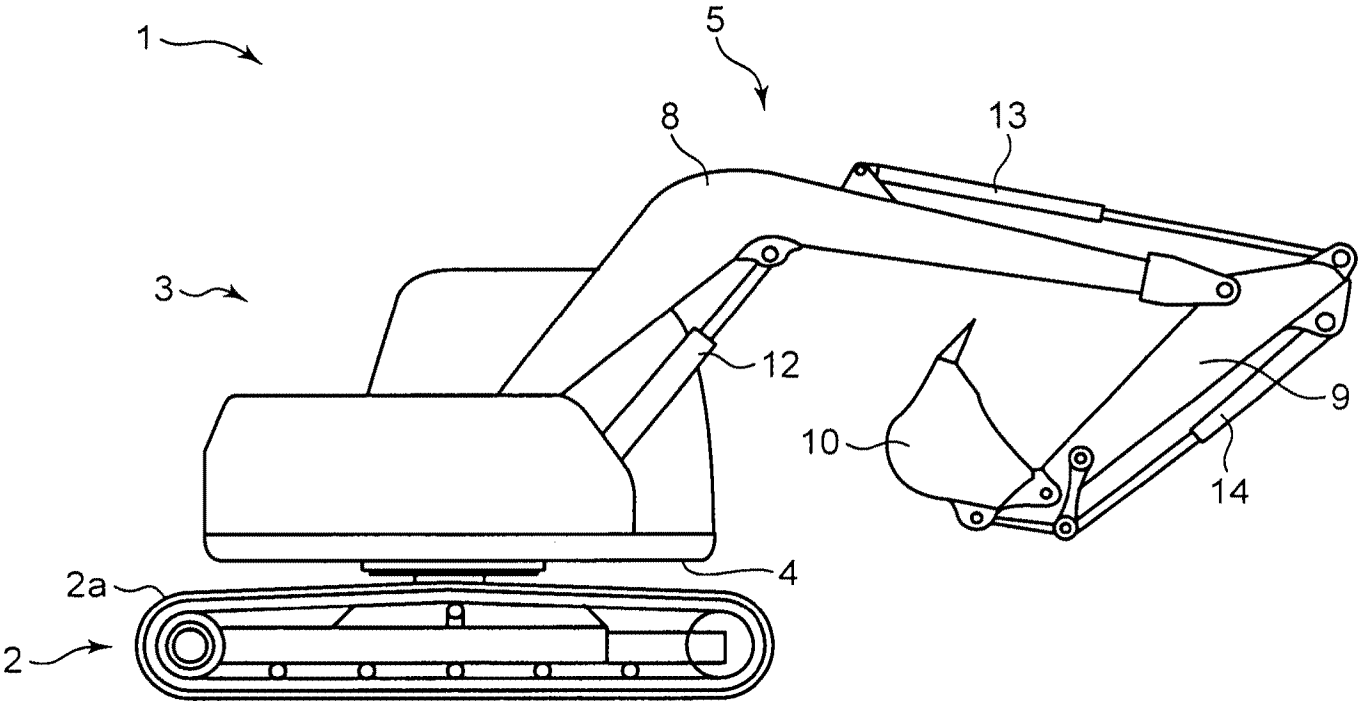
FIG. 1 is a right side view showing the entire configuration of a hydraulic excavator according to an embodiment of the present invention.

FIG. 1 is a right side view showing the entire configuration of a hydraulic excavator 1 according to an embodiment of the present invention.

Figure 2:
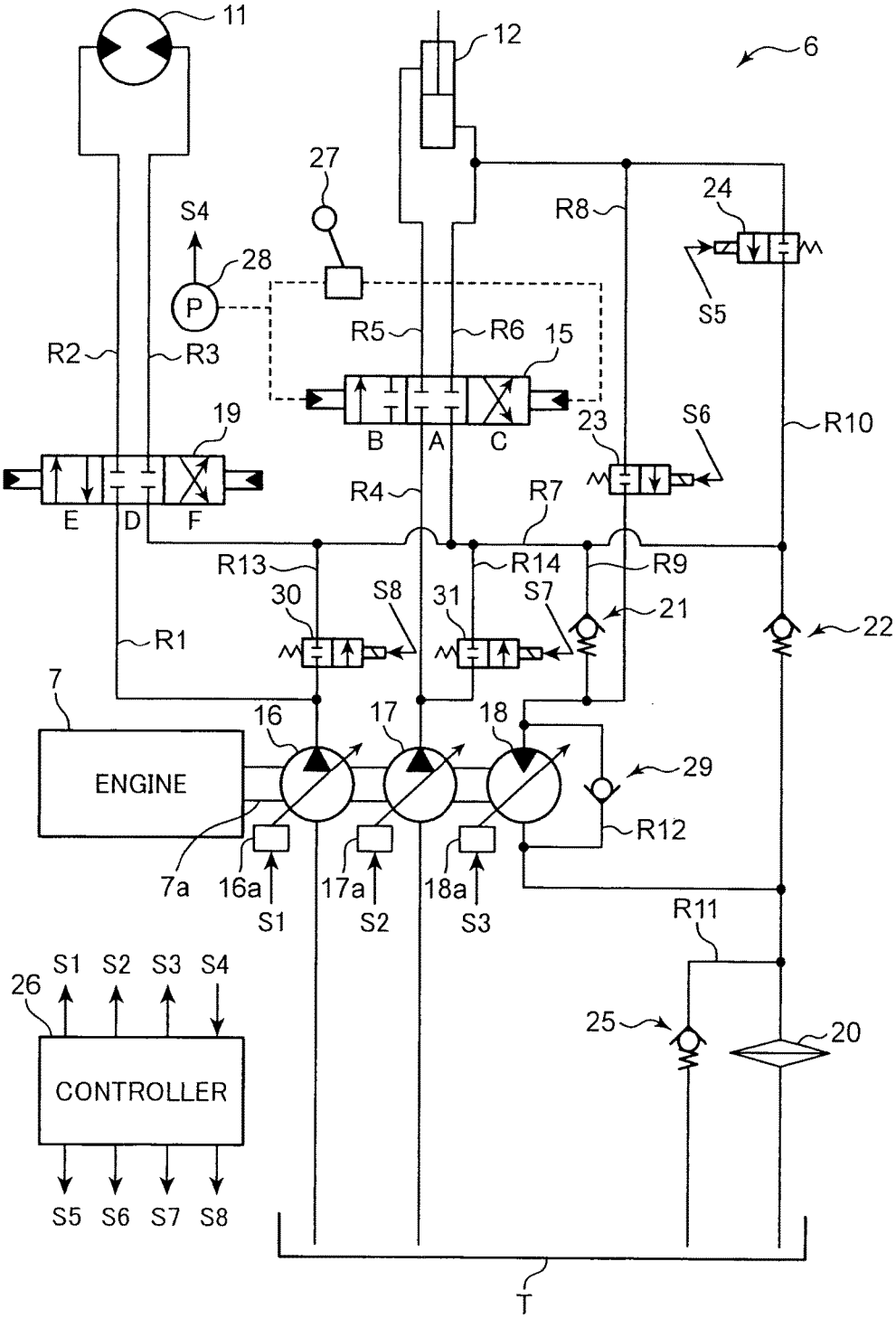
FIG. 2 is a circuit diagram showing a hydraulic control device provided in the hydraulic excavator shown in FIG. 1.

The hydraulic excavator 1 has a self-propelled lower propelling body 2 having a pair of right and left crawlers 2*a*, an upper slewing body 3 having an upper frame 4 provided on the lower propelling body 2 so as to be turnable with respect to the lower propelling body 2, a work attachment 5 provided on the upper slewing body 3 in such a manner as to be raised and lowered, a hydraulic control device 6 shown in FIG. 2, and an engine 7. In the present embodiment, the lower propelling body 2 and the upper slewing body 3 configure a base machine to which the work attachment 5 is attached in such a manner as to be raised and lowered.

The work attachment 5 has a boom 8 having a base end portion attached to the upper frame 4 in such a manner as to be raised and lowered with respect to the upper frame 4 of the upper slewing body 3, an arm 9 having a base end portion attached rotatably to a leading end portion of the boom 8, and a bucket 10 having a base end portion attached rotatably to a leading end portion of the arm 9.

As shown in FIGS. 1 and 2, the hydraulic control device 6 has a plurality of hydraulic actuators including a slewing motor 11 for turning the upper frame 4 with respect to the lower propelling body 2, a boom cylinder 12 for raising and lowering the boom 8 with respect to the upper frame 4, an arm cylinder 13 for rotating the arm 9 with respect to the boom 8, and a bucket cylinder 14 for rotating the bucket 10 with respect to the arm 9 (to be referred to hereinafter as a plurality of hydraulic actuators 11 to 14). In the present embodiment, return oil that is derived from the boom cylinder 12 of these hydraulic actuators 11 to 14 is the oil to be regenerated. In other words, in the present embodiment the boom cylinder 12 configures a regenerative actuator. In addition, in the present embodiment FIG. 2 shows the hydraulic control device 6 for driving the boom cylinder 12 and the slewing motor 11.

As shown in FIG. 2, the hydraulic control device 6 further has hydraulic pumps 16 and 17 for supplying hydraulic fluid to the slewing motor 11 and the boom cylinder 12 respectively, a regenerative motor 18 for regenerating return oil from the boom cylinder 12, a control valve 19 provided between the hydraulic pump 16 and the slewing motor 11, a control valve 15 provided between the hydraulic pump 17 and the boom cylinder 12, an oil cooler 20 for cooling the return oil, a regeneration-side check valve 21, a recovery-side check valve 22, a regeneration-side switching valve (regeneration valve) 23, a discharge-side switching valve (discharge valve) 24, a cooler protection valve 25, a controller (control unit) 26, an operation lever 27, a pressure sensor 28, a circulation check valve 29, a first unloading valve 30, and a second unloading valve 31.

The hydraulic pumps 16, 17 are driven by the rotation of an output shaft 7*a* of the engine 7. The hydraulic pumps 16, 17 are variable capacity-type pumps having regulators 16*a*, 17*a* for adjusting the capacities thereof. Hydraulic fluid discharged from the hydraulic pump 16 is guided to the control valve 19. Hydraulic fluid discharged from the hydraulic pump 17, on the other hand, is guided to the control valve 15.

The control valve 19 is a valve that is connected to the hydraulic pump 16 via a supply oil passage R1 and has a spool capable of controlling the supply and discharge of the hydraulic fluid to and from the slewing motor 11. The control valve 19 is operated by pilot pressure supplied from a pilot circuit, not shown. Specifically, the control valve 19 can be switched between a neutral position D where the activation of the slewing motor 11 is stopped, a switching position E where the slewing motor 11 is turned clockwise, and a switching position F where the slewing motor 11 is turned counterclockwise.

The control valve 15 is a switching valve that is connected to the hydraulic pump 17 via a supply oil passage R4 and has a spool capable of controlling the supply and discharge of the hydraulic fluid to and from the boom cylinder 12. The control valve 15 has a port that is connected to the pilot circuit generating a pilot pressure in accordance with an operating amount of the operation lever 27. The pilot circuit is provided with the pressure sensor 28 for detecting the pilot pressure. An electric signal indicating the pilot pressure detected by the pressure sensor 28 is transmitted to the controller 26 described below. The control valve 15 can be switched between a neutral position A where the activation of the boom cylinder 12 is stopped, a switching position B where the boom cylinder 12 is lowered, and a switching position C where the boom cylinder 12 is raised.

An individual oil passage R2 for turning the slewing motor 11 clockwise and an individual oil passage R3 for turning the slewing motor 11 counterclockwise are provided between the control valve 19 and the slewing motor 11. An individual oil passage R5 of the rod side of the boom cylinder 12 and an individual oil passage R6 of the head side of the boom cylinder 12 between the control valve 15 and the boom cylinder 12. A recovery oil passage R7 is provided between a tank T and the control valves 15, 19.

The regenerative motor 18 is provided on a regenerative oil passage R8 connected to the individual oil passage R6 of the head side of the boom cylinder 12. The regenerative oil passage R8 branches off from this head-side individual oil passage R6 and is connected to the regenerative motor 18 without the recovery oil passage R7 therebetween. The regenerative motor 18 is coupled to the output shaft 7*a* of the engine 7 by a one-way clutch or the like in such a manner as to rotate the output shaft 7*a* of the engine 7 in response to the supply of hydraulic fluid and in such a manner as to be driven to rotate by the rotation of the output shaft 7*a* of the engine 7. Furthermore, the regenerative motor 18 is a variable capacity-type motor that has a regulator 18*a* for adjusting the capacity thereof.

The regeneration-side check valve 21 is provided on a coupling oil passage R9 which couples the recovery oil passage R7 to a position in the regenerative oil passage R8 that is located upstream of the regenerative motor 18. The regeneration-side check valve 21 allows hydraulic fluid to flow from its upstream side (the recovery oil passage R7 side) toward its downstream side (the regenerative oil passage R8 side), while restricting the hydraulic fluid from flowing reversely. The regeneration-side check valve 21 is closed normally and is opened when the difference in pressure between its upstream side and its downstream side is equal to or greater than a second pressure (e.g., 0.3 Mpa).

The recovery-side check valve 22 is provided at a position of the recovery oil passage R7 located downstream (on the tank T side) of the connection between the recovery oil passage R7 and the coupling oil passage R9. The recovery-side check valve 22 allows the hydraulic fluid to flow from its upstream side (the control valves 15, 19 side) toward its downstream (the tank T side), while restricting the hydraulic fluid from flowing reversely. The recovery-side check valve 22 is closed normally and is opened when the difference in pressure between its upstream side and its downstream side is equal to or greater than a first pressure (e.g., 0.4 Mpa) which is greater than the second pressure. Therefore, while the hydraulic fluid to be derived from the control valves 15, 19 flows only through the regenerative oil passage R8 when the pressure thereof is equal to or greater than the second pressure but less than the first pressure, the hydraulic fluid with a pressure equal to or greater than the first pressure flows through both the recovery oil passage R7 and the regenerative oil passage R8. Note that the first pressure is greater than the second pressure in the present embodiment; however, the first pressure can be equivalent to the second pressure.

The regeneration-side switching valve 23 is provided at a position of the regenerative oil passage R8 located upstream (on the boom cylinder 12 side) of the connection between the regenerative oil passage R8 and the coupling oil passage R9. The regeneration-side switching valve 23 can be switched between its allowing state for allowing the return oil to flow through the regenerative oil passage R8 and its restricting state for restricting the same. Specifically, the regeneration-side switching valve 23 is switched by an electric signal S6 transmitted from the controller 26.

The discharge-side switching valve 24 is provided on a discharge oil passage R10 that couples the regenerative oil passage R8 and the recovery oil passage R7 to each other. The discharge oil passage R10 couples a position of the regenerative oil passage R8 that is located upstream of the regeneration-side switching valve 23 (on the boom cylinder 12 side) to a position of the recovery oil passage R7 that is located upstream of the recovery-side check valve 22. The discharge oil passage R10 guides, to the recovery oil passage R7, an excess portion of the return oil flowing from the head side of the boom cylinder 12. The excess portion is not used for regenerating the energy. The discharge-side switching valve 24 can be switched between its state of allowing the return oil to flow through the discharge oil passage R10 and its state of restricting the same. Specifically, the discharge-side switching valve 24 is switched by an electric signal S5 transmitted from the controller 26.

The first unloading valve 30 is provided in a first unloading oil passage R13 that couples the supply oil passage R1 of the hydraulic pump 16 and the recovery oil passage R7 to each other. The first unloading valve 30 is closed normally and is opened when the control valve 19 is switched to the neutral position D, to recover the hydraulic fluid from the hydraulic pump 16 into the tank T. Specifically, the first unloading valve 30 is switched by an electric signal S8 transmitted from the controller 26.

The second unloading valve 31 is provided on a second unloading oil passage R14 that couples the supply oil passage R4 of the hydraulic pump 17 and the recovery oil passage R7 to each other. The second unloading valve 31 is closed normally and is opened when the control valve 15 is switched to the neutral position A, to recover the hydraulic fluid from the hydraulic pump 17 into the tank T. Specifically, the second unloading valve 31 is switched by an electric signal S7 transmitted from the controller 26.

The oil cooler 20 is provided at a position of the recovery oil passage R7 located downstream (on the tank T side) of the recovery-side check valve 22. Note that the regenerative oil passage R8 is connected to the recovery oil passage R7 on the upstream side of the oil cooler 20. Therefore, hydraulic fluid flowing through the recovery oil passage R7 and the regenerative oil passage R8 is cooled by the oil cooler 20 and then recovered into the tank T.

The cooler protection valve 25 is provided on a cooler bypass oil passage R11 that bypasses the oil cooler 20 in order to guide the return oil to the tank T without going through the oil cooler 20. Specifically, the cooler bypass oil passage R11 branches off from the recovery oil passage R7 at a position upstream of the oil cooler 20. The cooler protection valve 25 allows the hydraulic fluid to flow from its upstream side toward its downstream side, while restricting the hydraulic fluid from flowing reversely. The cooler protection valve 25 is closed normally and is opened when the pressure of the return oil on its upstream side is equal to or greater than a predetermined pressure. Therefore, while the entire return oil flows through the oil cooler 20 when the pressure of the return oil is less than the predetermined pressure, an excess portion of the return oil flows through the cooler bypass oil passage R11 when the pressure of the return oil is equal to or greater than the predetermined pressure. The oil cooler 20 is protected in this manner.

The circulation check valve 29 is provided on a motor bypass oil passage R12 that bypasses the regenerative motor 18, and, if necessary, circulates the hydraulic fluid flowing on the downstream side of the regenerative motor 18, to the upstream side of the regenerative motor 18. Specifically, the circulation check valve 29 couples the positions on the upstream side and the downstream side of the regenerative motor 18 in the regenerative oil passage R8 to each other. The circulation check valve 29 allows the hydraulic fluid to flow from the downstream side toward the upstream side, while restricting the hydraulic fluid from flowing reversely.

During a regeneration period in which the return oil flowing from the boom cylinder 12 can be regenerated, the controller 26 sets the capacity of the regenerative motor 18 at a regeneration capacity to enable regeneration of the return oil, and adjusts the opening degree of the regeneration-side switching valve 23 in such a manner as to allow the return oil to flow via the regenerative oil passage R8. During a non-regeneration period other than the regeneration period, the controller 26 sets the capacity of the regenerative motor 18 at a non-regeneration capacity smaller than the regeneration capacity, and adjusts the opening degree of the regeneration-side switching valve 23 in such a manner as to restrict the flow of the return oil through the regenerative oil passage R8.

More specifically, the controller 26 is electrically connected to the regulators 16*a*, 17*a* of the respective hydraulic pumps 16, 17, the regulator 18*a* of the regenerative motor 18, a solenoid of the regeneration-side switching valve 23, a solenoid of the discharge-side switching valve 24, the pressure sensor 28, a solenoid of the first unloading valve 30, and a solenoid of the second unloading valve 31. The controller 26 adjusts the capacities of the hydraulic pumps 16, 17 and regenerative motor 18 by outputting signals S1 to S3 to the regulators 16*a*, 17*a*, and 18*a*. The controller 26 also determines, based on an output signal S4 transmitted from the pressure sensor 28, whether or not an operation for lowering the boom is carried out by the operation lever 27. The controller 26 determines the regeneratable period when the operation for lowering the boom is carried out, and determines the non-regeneration period when the operation for lowering the boom is not carried out.

Upon determination of the regeneratable period, the controller 26 determines whether the whole return oil from the boom cylinder 12 can be regenerated or not. Specifically, when the power of the regenerative motor 18 using the whole return oil is greater than the power of the hydraulic pumps 16, 17, or when the flow rate of the return oil flowing from the boom cylinder 12 is greater than the maximum absorption flow rate of the regenerative motor 18 (maximum capacity×rotation speed), the controller 26 determines that the whole return oil cannot be regenerated. When it is determined that the whole return oil can be regenerated, the controller 26 opens the regeneration-side switching valve 23 completely and closes the discharge-side switching valve 24 completely. When it is determined that the whole return oil cannot be regenerated, the controller 26 adjusts the opening degree of the discharge-side switching valve 24 so that an excess portion of the return oil flows through the discharge-side switching valve 24. Upon determination of the period is the non-regeneration period, the controller 26 closes both the regeneration-side switching valve 23 and the discharge-side switching valve 24 completely.

Figure 3:
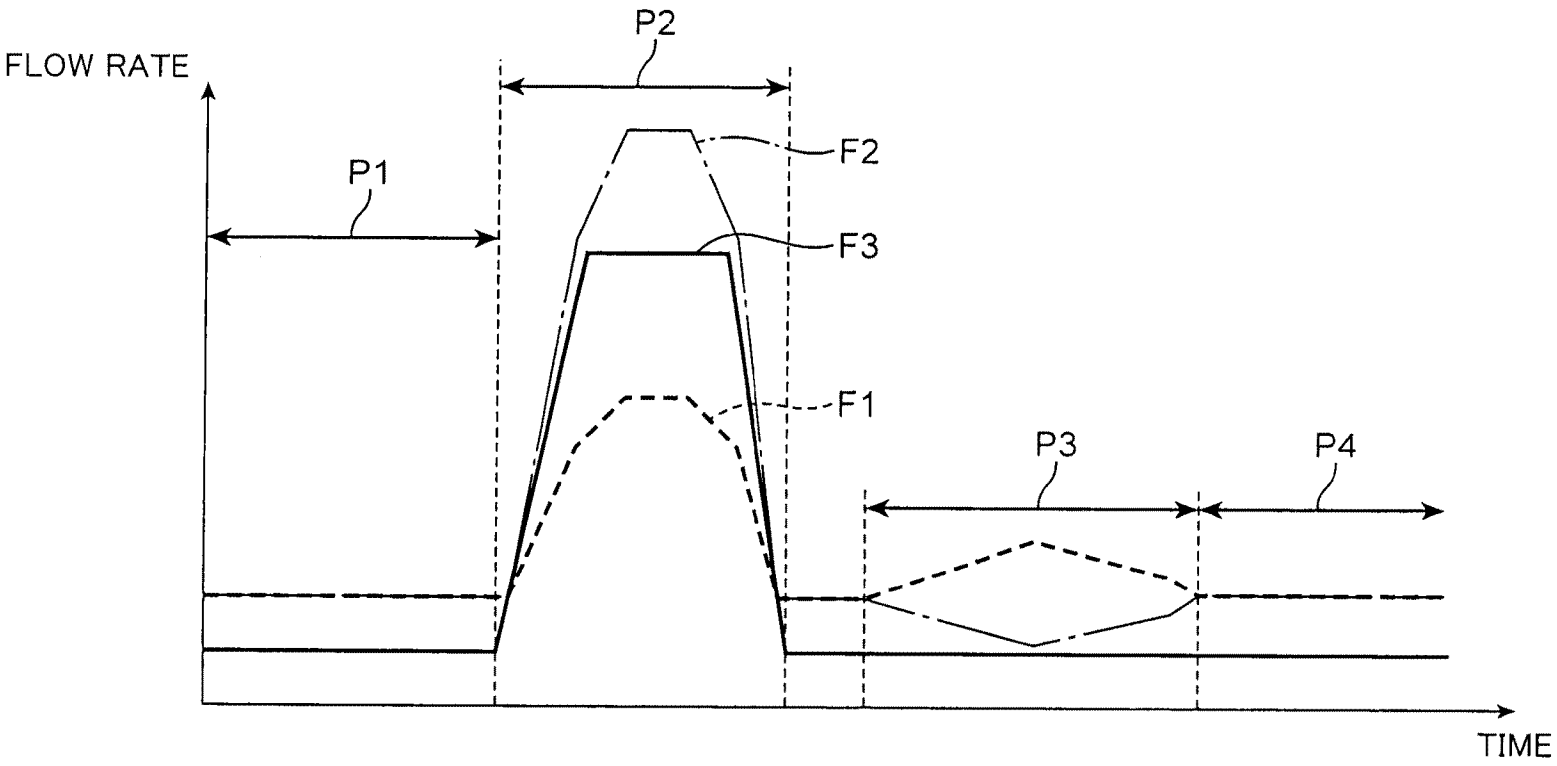
FIG. 3 is a chart showing the relationship among a discharge flow rate of a hydraulic pump shown in FIG. 2, a flow rate of return oil, and a flow rate of hydraulic fluid flowing to a regenerative motor.

Flow rate control that is executed on the hydraulic pumps 16, 17 and the regenerative motor 18 by the controller 26 is now described hereinafter with reference to FIG. 3. In FIG. 3, reference numerals P1 and P4 represent non-operation periods in which the operation lever is not operated, reference numeral P2 represents a boom lowering period in which an operation for lowering the boom is execute, and reference numeral P3 represents an arm pulling period in which operations other than lowering of the boom are executed (e.g., an arm pulling operation). In other words, the period P2 represents the regeneratable period, and the periods P1, P3, and P4 each represent the non-regeneration period.

The controller 26 controls the capacity of the hydraulic pumps 16, 17 and/or the capacity of the regenerative motor 18 so that a flow rate F3 of the regenerative motor 18 becomes lower than a flow rate F2 of the return oil throughout each of the periods P1 to P4. Each of the periods P1 to P4 is described hereinafter.

In the non-operation periods P1 and P4, the controller 26 sets the capacity of the hydraulic pumps 16, 17 at a basic capacity which is determined beforehand. The controller 26 also sets the capacity of the regenerative motor 18 at a non-regeneration capacity which is determined beforehand The basic capacity and the non-regeneration capacity are set in such a manner that a flow rate F1 of the hydraulic pumps 16, 17 becomes greater than the flow rate F3 of the regenerative motor 18. Because the hydraulic fluid discharged from the hydraulic pumps 16, 17 does not perform tasks in the non-operation periods P1 and P4, the flow rate F1 of the hydraulic pumps 16, 17 is equivalent to the flow rate F2 of the return oil.

In the boom lowering period P2, the controller 26 adjusts the capacity of the hydraulic pumps 16, 17 to a boom lowering capacity (the flow rate F1) in accordance with an operating amount of the operation lever 27. The flow rate F2 of the return oil becomes greater than the discharge flow rate F1 of the hydraulic pumps 16, 17 corresponding to the ratio between the area for receiving pressure in a rod-side chamber of the boom cylinder 12 and the area for receiving pressure in a head-side chamber of the boom cylinder 12. The controller 26 sets the capacity of the regenerative motor 18 at a regeneration capacity greater than the non-regeneration capacity. The boom lowering capacity and the non-regeneration capacity are set in such a manner that the flow rate F3 of the regenerative motor 18 becomes lower than the flow rate F2 of the return oil.

In the arm pulling period P3, the controller 26 adjusts the capacity of the hydraulic pumps 16, 17 to an arm pulling capacity (the flow rate F1) in response to an operating amount of the operation lever 27. The flow rate F2 of the return oil becomes lower than the discharge flow rate F1 of the hydraulic pumps 16, 17 corresponding to the ratio between the area for receiving pressure in a rod-side chamber of the arm cylinder 13 and the area for receiving pressure in a head-side chamber of the arm cylinder 13. The controller 26 then sets the capacity of the regenerative motor 18 at the non-regeneration capacity. The arm pulling capacity and the non-regeneration capacity are set in such a manner that the flow rate F3 of the regenerative motor 18 becomes lower than the flow rate F2 of the return oil.

The operations of the hydraulic control device 6 are now described hereinbelow.

During a period in which a boom lowering operation is executed (the regeneratable period), the opening degree of the regeneration-side switching valve 23 is adjusted to a predetermined opening degree (the regeneration-side switching valve 23 is switched to its allowing state). As a result, the return oil from the boom cylinder 12 is supplied to the regenerative motor 18 in accordance with the opening degree of the regeneration-side switching valve 23.

In periods other than the period in which the boom lowering operation is executed (non-regeneration periods), the regeneration-side switching valve 23 and the discharge-side switching valve 24 are closed completely (the regeneration-side throttle 23 is switched to its restricting state). In this condition, while the capacity of the regenerative motor 18 is set at the non-regeneration capacity (minimum capacity), the return oil flowing through the regeneration-side switching valve 23 is not supplied to the regenerative motor 18, possibly causing cavitation in the regenerative motor 18. The present embodiment, therefore, is configured to be able to guide the hydraulic fluid from the recovery oil passage R7 to the regenerative oil passage R8 through the coupling oil passage R9, preventing the occurrence of cavitation in the regenerative motor 18.

The hydraulic fluid recovered into the tank T during the regeneratable period and the non-regeneration periods is cooled by the oil cooler 20. When an excess portion of the hydraulic fluid is guided to the oil cooler 20, the cooler protection valve 25 opens up to protect the oil cooler 20.

As described above, in the present embodiment, the regeneration-side check valve 21, which allows the hydraulic fluid to flow from the recovery oil passage R7 to the regenerative motor 18 and restricts the hydraulic fluid from flowing reversely, is provided on the coupling oil passage R9 coupling the recovery oil passage R7 and the regenerative oil passage R8. According to this structure, even when the regeneration does not take place, in other words even when the return oil is not supplied from the boom cylinder 12 to the regenerative motor 18 via the regenerative oil passage R8, the hydraulic fluid can be supplied from the recovery oil passage R7 to the regenerative motor 18 via the regeneration-side check valve 21. As a result, the occurrence of cavitation in the regenerative motor 18 during the non-regeneration periods can be suppressed, while executing regeneration using the return oil flowing from the boom cylinder 12 during the regeneration period.

In particular, according to the present embodiment, the regenerative motor 18 can be supplied with the hydraulic fluid recovered from the hydraulic actuators 11 to 14 into the tank T, which, in other words, is hydraulic fluid of relatively low pressure that is not originally planned to perform tasks. Thus, the configuration of the present embodiment can significantly reduce the loss of power, as compared to when supplying to the regenerative motor 18 the hydraulic fluid derived from a pilot pump.

Moreover, the regeneration-side check valve 21 is required to function to restrict the flow of hydraulic fluid from the regenerative oil passage R8 to the recovery oil passage R7. However, because the recovery oil passage R7 is of relatively low pressure that is connected to the tank T, the pressure for opening the regeneration-side check valve 21 can be set lower than the pressure for opening a check valve provided between a pilot circuit and an oil passage in a conventional structure. Such configuration, too, can reduce the loss of power.

Therefore, the present invention can suppress the occurrence of cavitation in the regenerative motor 18 that regenerates the energy of the hydraulic actuators 11 to 14, while reducing the loss of power.

The embodiment has illustrated the boom cylinder 12 as an example of a regenerative actuator; however, the present invention is not limited to this embodiment. Provided that the potential energy or inertial energy can be reproduced, the other hydraulic actuators (e.g., the slewing motor 11, the arm cylinder 13, and the bucket cylinder 14) can be used as the regenerative actuators.

In the present embodiment, the recovery-side check valve 22 is provided on the recovery oil passage R7, and the regeneration-side check valve 21 is opened at pressure equivalent to or lower than pressure set for the recovery-side check valve 22. According to this configuration, when the return oil from the boom cylinder 12 is not supplied to the regenerative oil passage R8, the return oil from the recovery oil passage R7 can be guided reliably to the regenerative motor 18, and at the same time an excess portion of the return oil can be recovered into the tank. Consequently, the occurrence of cavitation in the regenerative motor 18 can be suppressed more reliably.

The embodiment also has the controller 26 that switches the regeneration-side switching valve 23 to its allowing state during the regeneration period and to its restricting state during the periods other than the regeneration period. According to such configuration of the embodiment, while the return oil from the boom cylinder 12 can be guided to the regenerative motor 18 during the regeneration period, the return oil from the recovery oil passage R7 can be guided to the regenerative motor 18 during the periods other than the regeneration period.

In the embodiment, the discharge oil passage R10 is provided with the discharge-side switching valve 24. Therefore, an excess portion of the return oil of the return oil from the boom cylinder 12 can be guided to the recovery oil passage R7 via the discharge oil passage R10 and the discharge-side switching valve 24.

Another embodiment of the present invention is now described hereinafter with reference to FIG. 4. The same reference numerals are used for indicating the configurations same as those described in the aforementioned embodiment, and therefore the overlapping explanations are omitted accordingly.

Figure 4:
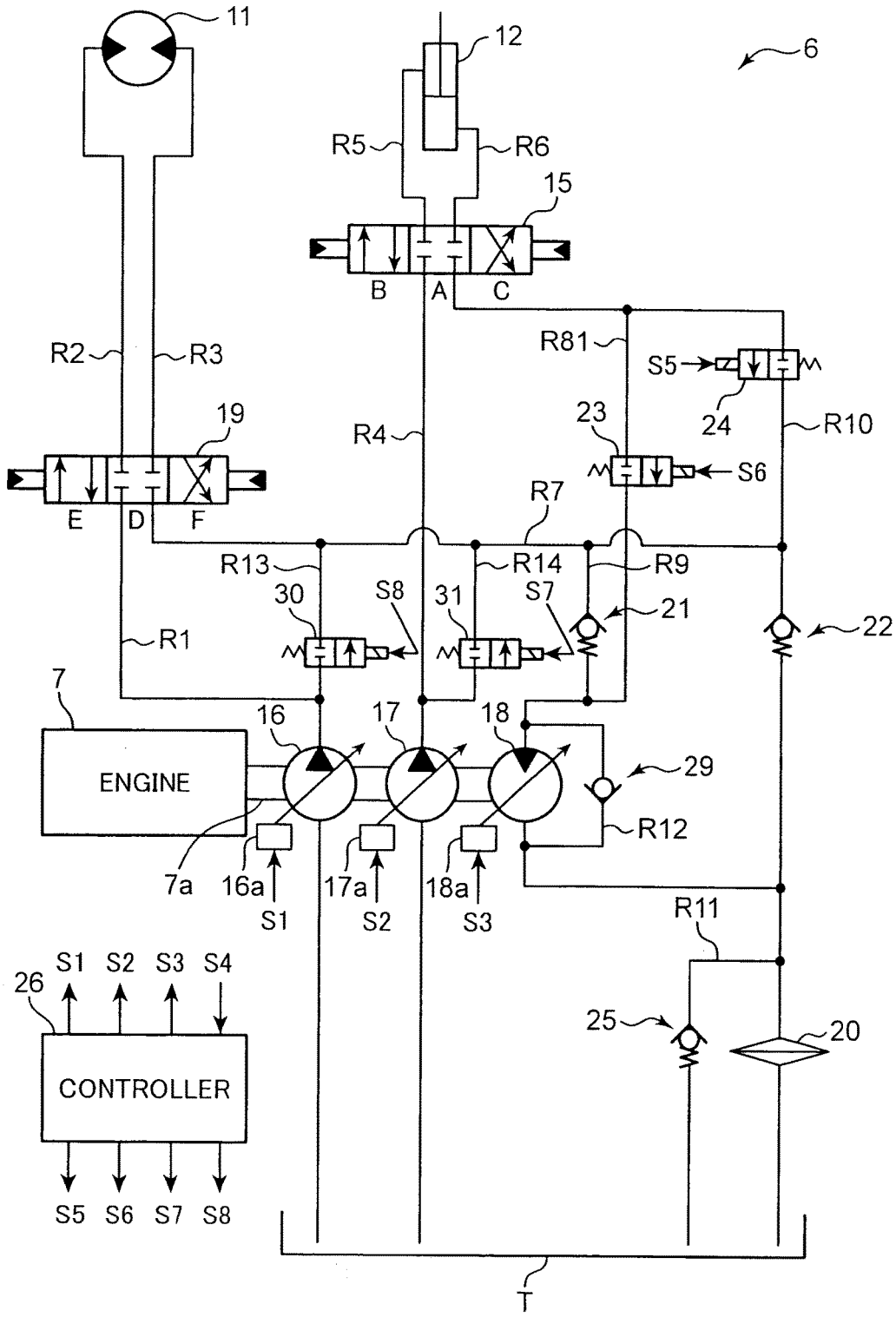
FIG. 4 is a diagram corresponding to FIG. 2, showing another embodiment of the present invention.

The hydraulic control device 6 according to the aforementioned embodiment has the regenerative oil passage R8 provided on the upstream side of the control valve 15 (see FIG. 2), but the hydraulic control device 6 shown in FIG. 4 has a regenerative oil passage R81 provided on the downstream side of the control valve 15.

Specifically, the regenerative oil passage R81 connects the control valve 15 and the regenerative motor 18 to each other via the regeneration-side switching valve 23 therebetween. The discharge oil passage R10 couples the recovery oil passage R7 to a position on the regenerative oil passage R81 that is located upstream (the control valve 15 side) of the regeneration-side switching valve 23. In other words, unlike the embodiment described above, in this embodiment the control valve 15 is not connected directly to the recovery oil passage R7.

In this embodiment, when the control valve 15 is switched to the switching position B in order to perform the boom lowering act, the required amount among the hydraulic fluid derived from the head side of the boom cylinder 12 is guided to the regenerative motor 18, whereas an excess portion of the hydraulic fluid is recovered into the tank T. Specifically, the controller 26 adjusts the opening degrees of the regeneration-side switching valve 23 and the discharge-side switching valve 24.

When, on the other hand, the control valve 15 is switched to the switching position C in order to perform a boom lifting act, the hydraulic fluid derived from the rod side of the boom cylinder 12 passes through the recovery oil passage R7 and is recovered into the tank T. Specifically, the controller 26 sets the opening degrees of the regeneration-side switching valve 23 as completely closed and the opening degrees of the discharge-side switching valve 24 as completely opened.

During the periods other than the period for executing the boom lowering operation, the opening degrees of the regeneration-side switching valve 23 are set as completely closed. In this state, although the capacity of the regenerative motor 18 is set at the non-regeneration capacity (minimum capacity), the return oil flowing through the regeneration-side switching valve 23 is not supplied to the regenerative motor 18, possibly resulting in generating cavitation in the regenerative motor 18. In the present embodiment as well, the hydraulic fluid can be guided from the recovery oil passage R7 to the recovery oil passage R8 via the coupling oil passage R9, preventing the occurrence of cavitation in the regenerative motor 18.

The specific embodiments described above mainly include the invention having the following configurations.

In other words, the present invention provides a hydraulic control device, which has: a hydraulic pump that is driven by rotation of an output shaft of an engine; at least one hydraulic actuator that is activated by a supply of hydraulic fluid from the hydraulic pump and includes a regenerative actuator, return oil to be derived from the regenerative actuator being used for regeneration; a recovery oil passage for recovering, into a tank, the hydraulic fluid derived from the at least one hydraulic actuator and the hydraulic pump; a regenerative motor that rotates the output shaft of the engine in response to the supply of the hydraulic fluid and is driven to rotate by rotation of the output shaft of the engine; a regenerative oil passage for guiding the return oil from the regenerative actuator to the regenerative motor without passing the return oil through the recovery oil passage; a coupling oil passage that couples the recovery oil passage and the regenerative oil passage to each other; and a regeneration-side check valve that is provided on the coupling oil passage, allows the hydraulic fluid to flow from the recovery oil passage toward the regenerative motor, and restricts the hydraulic fluid from flowing from the regenerative motor toward the recovery oil passage.

The hydraulic control device according to the present invention has the regeneration-side check valve that is provided on the coupling oil passage coupling the recovery oil passage and the regenerative oil passage to each other, allows the hydraulic fluid to flow from the recovery oil passage to the regenerative motor, and restricts the hydraulic fluid from flowing reversely. Therefore, even when the regeneration does not take place, in other words even when the return oil is not supplied from the regenerative actuator to the regenerative motor via the regenerative oil passage, the hydraulic fluid can be supplied from the recovery oil passage to the regenerative motor via the regeneration-side check valve. Accordingly, while performing the regeneration using the return oil from the regenerative actuator during the regeneration period, the occurrence of cavitation in the regenerative motor can be suppressed in the non-regeneration period.

Particularly, in the present invention, the hydraulic fluid that is recovered from the at least one hydraulic actuator into the tank, in other words, the hydraulic fluid of relatively low pressure that is not originally planned to perform tasks can be supplied to the regenerative motor. Thus, the loss of power can be significantly reduced, as compared to when the hydraulic fluid derived from a pilot pump is supplied to the regenerative motor.

Moreover, the regeneration-side check valve according to the present invention is required to function to restrict the flow of hydraulic fluid from the regenerative oil passage to the recovery oil passage. However, because the pressure in the recovery oil passage connected to the tank is relatively low, the pressure for opening the regeneration-side check valve can be set lower than the pressure for opening a check valve provided between a pilot circuit and an oil passage in a conventional structure. Such configuration, too, can reduce the loss of power.

The present invention, therefore, can suppress the occurrence of cavitation in the regenerative motor for regenerating the energy of the hydraulic actuator, while reducing the loss of power.

Note in the present invention that the term "regeneration" means not only to generate electric power but also to reuse the return oil from the hydraulic actuator in order to drive the regenerative motor.

It is preferred that the hydraulic control device further have a recovery-side check valve that is provided downstream of the connection between the recovery oil passage and the coupling oil passage, and that is closed normally, and moreover allows the hydraulic fluid to flow from the upstream side toward the downstream side when a pressure on the upstream side is equal to or greater than a set pressure. The regeneration-side check valve is opened at a pressure equivalent to or lower than the set pressure of the recovery-side check valve.

According to this aspect, the recovery-side check valve is provided on the recovery oil passage, and the regeneration-side check valve is opened at a pressure equal to or lower than the set pressure of the recovery-side check valve. Therefore, when the return oil from the regenerative actuator is not supplied to the regenerative oil passage, the return oil from the recovery oil passage can reliably be guided to the regenerative motor, and at the same time an excess portion of the return oil can be recovered into the tank. In this manner, the occurrence of cavitation in the regenerative motor can reliably be suppressed.

It is preferred that the hydraulic control device further have a regeneration valve that is provided upstream of the connection between the regenerative oil passage and the coupling oil passage and can be switched between an allowing state for allowing the return oil to flow through the regenerative oil passage and a restricting state for restricting the flow of the return oil, and a control unit that switches the regeneration valve to the allowing state during a regeneration period in which the return oil from the regenerative actuator can be regenerated, and switches the regeneration valve to the restricting state during a period other than the regeneration period.

According to this aspect, the hydraulic control device has a controller that switches the regeneration valve to the allowing state during the regeneration period and to the restricting state during a period other than the regeneration period. Owing to such aspect, while guiding the return oil from the regenerative actuator to the regenerative motor during the regeneration period, the return oil from the recovery oil passage can be guided to the regenerative motor during a period other than the regeneration period.

It is preferred that the hydraulic control device further have a discharge oil passage that couples the recovery oil passage to a position of the regenerative oil passage located upstream of the connection between the regenerative oil passage and the coupling oil passage, and a discharge valve for guiding, to the recovery oil passage, return oil other than the return oil to be supplied to the regenerative motor out of return oil from the regenerative actuator, the discharge valve provided on the discharge oil passage.

According to this aspect, the discharge oil passage is provided with a discharge valve. Therefore, an excess portion of the return oil from the regenerative actuator can be guided to the recovery oil passage via the discharge oil passage and the discharge valve.

The present invention also provides an operating machine having: a base machine; a boom attached to the base machine so as to be raised and lowered with respect to the base machine; a boom cylinder that raises and lowers the boom with respect to the base machine; and the hydraulic control device, wherein the hydraulic control device includes the boom cylinder as the regenerative actuator.

According to the present invention, the boom cylinder is provided as the regenerative actuator. Thus, the return oil from the boom cylinder can be regenerated. Specifically, when lowering the boom, the potential energy of the boom acts in the direction of accelerating the boom. The potential energy, therefore, can be recovered as the power of the regenerative motor. When not regenerating the return oil from the boom cylinder, the return oil from the recovery oil passage can be supplied to the regenerative motor, suppressing the occurrence of cavitation in the regenerative motor. In particular, in the present invention, the return oil to be recovered to the tank, in other words, hydraulic fluid of relatively low pressure that is not originally planned to perform tasks can be supplied to the regenerative motor. Thus, the loss of power can be significantly reduced, as compared to when supplying the hydraulic fluid derived from a pilot pump to the regenerative motor.

In conclusion, the present invention can suppress the occurrence of cavitation in the regenerative motor that regenerates the energy of the hydraulic actuator, while reducing the loss of power.

INDUSTRIAL APPLICABILITY

The present invention can suppress the occurrence of cavitation in the regenerative motor that regenerates the energy of the hydraulic actuator, while reducing the loss of power.

EXPLANATION OF REFERENCE NUMERALS

R7 Recovery oil passage
R8 Regenerative oil passage
R81 Regenerative oil passage
R9 Coupling oil passage
R10 Discharge oil passage
T Tank
1 Hydraulic excavator (an example of the operating machine)
2 Lower propelling body (an example of the base machine)
3 Upper slewing body (an example of the base machine)
5 Work attachment
6 Hydraulic control device
7 Engine
7*a* Output shaft
11 Slewing motor (an example of the hydraulic actuator)
12 Boom cylinder (an example of the regenerative actuator)
13 Arm cylinder (an example of the hydraulic actuator)
14 Bucket cylinder (an example of the hydraulic actuator)
16, 17 Hydraulic pump
18 Regenerative motor
21 Regeneration-side check valve
22 Recovery-side check valve
23 Regeneration-side switching valve (an example of the regeneration valve)
24 Discharge-side switching valve (an example of the discharge valve)
26 Controller (an example of the control unit)

The invention claimed is:

1. A hydraulic control device, comprising:

a hydraulic pump that is driven by rotation of an output shaft of an engine;

at least one hydraulic actuator that is activated by a supply of hydraulic fluid from the hydraulic pump and includes a regenerative actuator, a part of return oil to be derived from the regenerative actuator being used for regeneration;

a recovery oil passage for recovering, into a tank, the hydraulic fluid derived from the at least one hydraulic actuator and the hydraulic pump;

a regenerative motor that rotates the output shaft of the engine in response to the supply of the hydraulic fluid and is driven to rotate by rotation of the output shaft of the engine;

a regenerative oil passage for guiding the return oil from the regenerative actuator to the regenerative motor without passing the return oil through the recovery oil passage;

a coupling oil passage that couples the recovery oil passage and the regenerative oil passage to each other;

a regeneration-side check valve that is provided on the coupling oil passage, allows the hydraulic fluid to flow from the recovery oil passage toward the regenerative motor through the coupling oil passage, and prevents the hydraulic fluid from flowing from the regenerative motor toward the recovery oil passage through the coupling oil passage, a recovery-side check valve that is provided in a position of the recovery oil passage between the tank and a recovery connection between the recovery oil passage and the coupling oil passage, and that is closed normally, and moreover allows the hydraulic fluid to flow from the recovery connection side toward the tank side when a pressure on the recovery connection side is equal to or greater than a set pressure; and a regeneration valve that is provided in a position of the regenerative oil passage located upstream of a regeneration connection between the regenerative oil passage and the coupling oil passage and can be switched between an allowing state for allowing the return oil to flow through the regenerative oil passage and a restricting state for restricting the flow of the return oil through the regenerative oil passage, and that is a two-port valve;

wherein the regeneration-side check valve is opened at a pressure equivalent to or lower than the set pressure of the recovery-side check valve.

2. The hydraulic control device according to claim 1, further comprising:

a control unit that switches the regeneration valve to the allowing state during a regeneration period in which the return oil from the regenerative actuator can be regenerated, and switches the regeneration valve to the restricting state during a period other than the regeneration period.

3. The hydraulic control device according to claim 1, further comprising:

a discharge oil passage that couples the recovery oil passage to a position of the regenerative oil passage located upstream of a regeneration connection between the regenerative oil passage and the coupling oil passage; and a discharge valve for guiding, to the recovery oil passage, return oil other than the return oil to be supplied to the regenerative motor out of return oil from the regenerative actuator, the discharge valve provided on the discharge oil passage.

4. An operating machine, comprising:

a base machine;

a boom attached to the base machine so as to be raised and lowered with respect to the base machine;

a boom cylinder that raises and lowers the boom with respect to the base machine; and the hydraulic control device according to claim 1, wherein the hydraulic control device includes the boom cylinder as the regenerative actuator.

* * * * *